US007331196B2

(12) United States Patent
Itsuki et al.

(10) Patent No.: US 7,331,196 B2
(45) Date of Patent: Feb. 19, 2008

(54) REFRIGERATING APPARATUS AND REFRIGERATOR

(75) Inventors: Hiroyuki Itsuki, Gunma (JP); Hiroshi Mukaiyama, Gunma (JP); Satoshi Imai, Gunma (JP); Masahisa Otake, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 252 days.

(21) Appl. No.: 11/314,027

(22) Filed: Dec. 22, 2005

(65) Prior Publication Data

US 2006/0137386 A1 Jun. 29, 2006

(30) Foreign Application Priority Data

Dec. 28, 2004 (JP) ..... 2004-378860

(51) Int. Cl.
*F25B 1/10* (2006.01)
*F25B 41/00* (2006.01)

(52) U.S. Cl. ..... 62/510; 62/513

(58) Field of Classification Search ..... 62/199, 62/505, 510, 512, 513, 197, 222, 224
See application file for complete search history.

(56) References Cited

U.S. PATENT DOCUMENTS 5,103,650 A * 4/1992 Jaster ..... 62/198
5,109,678 A * 5/1992 Jaster et al. ..... 62/175
5,134,859 A * 8/1992 Jaster ..... 62/503
6,070,421 A * 6/2000 Petrovich et al. ..... 62/210
6,178,761 B1 * 1/2001 Karl ..... 62/159
6,260,367 B1 * 7/2001 Furuya et al. ..... 62/197
6,321,564 B1 * 11/2001 Yamanaka et al. ..... 62/510
6,679,320 B2 * 1/2004 Stefan ..... 165/202
6,698,234 B2 * 3/2004 Gopalnarayanan et al. ... 62/505
6,786,057 B2 * 9/2004 Ben Yahia ..... 62/222
7,131,291 B2 * 11/2006 Aflekt et al. ..... 62/498

FOREIGN PATENT DOCUMENTS

JP 2003-106693 4/2003

* cited by examiner

*Primary Examiner*—Mohammad M. Ali
(74) *Attorney, Agent, or Firm*—McDermott Will & Emery LLP

(57) ABSTRACT

In the case that heat absorbing means that function in selectively different temperature ranges, are provided in a refrigerating cycle, an object is to provide a refrigerating apparatus capable of suppressing the deterioration of efficiency in either temperature range to make a highly efficient operation possible. The refrigerating apparatus includes a compressor, a radiator, first heat absorbing means, and second heat absorbing means provided in parallel with the first heat absorbing means. The first heat absorbing means includes first decompressing means, a first heat absorber, and a first heat exchanger capable of heat exchange between a refrigerant which has come from the first heat absorber and a refrigerant flowing in the first decompressing means. The second heat absorbing means includes second decompressing means, a second heat absorber, and a second heat exchanger capable of heat exchange between a refrigerant which has come from the second heat absorber and a refrigerant flowing in the second decompressing means.

9 Claims, 6 Drawing Sheets

REFRIGERATING APPARATUS AND REFRIGERATOR

BACKGROUND OF THE INVENTION

The present invention relates to a refrigerating apparatus including means that can introduce a gaseous refrigerant separated by a gas-liquid separator, into an intermediate pressure portion of a compressor, and to a refrigerator including the refrigerating apparatus.

Generally known is a refrigerating apparatus including a compressor, a radiator, a decompressor, and a gas-liquid separator; and further including means that can introduce a gaseous refrigerant separated by the gas-liquid separator, into an intermediate pressure portion of the compressor (see JP-A-2003-106693). In a refrigerating apparatus of this kind, because the gaseous refrigerant separated by the gas-liquid separator is introduced into the intermediate pressure portion of the compressor while the refrigerant is kept in the gas state, the efficiency of the compressor can be improved.

On the other hand, in a conventional refrigerating apparatus of this kind, there is a case where heat absorbing means including heat absorbers that function in selectively different temperature ranges are provided in a refrigerating cycle.

For example, in the case that the above is applied to a refrigerator including a refrigerating room and a freezing room, heat absorbers that function for refrigerating or freezing are disposed in a refrigerating cycle and a refrigerating or freezing operation is carried out by using the function of one of the heat absorbers. In this case, in either operation, it is required to operate the refrigerator with high efficiency by suppressing the deterioration of the efficiency to the minimum.

SUMMARY OF THE INVENTION

An object of the present invention is to provide a refrigerating apparatus and a refrigerator including the refrigerating apparatus which suppress the deterioration of efficiency thereof and enable a high efficient operation even in either of selectively different temperature ranges, in a case where heat absorbing means which function in the selectively different temperature ranges are provided in a refrigerating cycle.

A first invention of the present application is directed to a refrigerating apparatus comprising a compressor, a radiator connected to a discharge side of the compressor, first heat absorbing means connected to an outlet side of the radiator, and second heat absorbing means provided in parallel with the first heat absorbing means, outlet sides of the first and second heat absorbing means being connected to a suction side of the compressor, the first heat absorbing means comprising first decompressing means, a first heat absorber, and a first heat exchanger configured to carry out heat exchange between a refrigerant which has come from the first heat absorber and a refrigerant flowing in the first decompressing means, and the second heat absorbing means comprising a second decompressing means, a second heat absorber, and a second heat exchanger configured to carry out heat exchange between a refrigerant which has come from the second heat absorber and a refrigerant flowing in the second decompressing means.

A second invention of the present application is directed to the refrigerating apparatus according to the first invention, wherein the compressor has an intermediate pressure portion, the second heat absorbing means further comprises a decompressor and a gas-liquid separator between the radiator and the second decompressing means, the refrigerating apparatus being provided with a refrigerant introducing pipe to introduce a gaseous refrigerant separated by the gas-liquid separator, into the intermediate pressure portion.

A third invention of the present application is directed to the refrigerating apparatus according to the first invention, wherein the first decompressing means comprises a capillary tube and an expansion valve, and the second decompressing means comprises a capillary tube.

A fourth invention of the present application is directed to the refrigerating apparatus according to any one of the first to third inventions, wherein the first and second heat absorbing means function in selectively different temperature ranges.

A fifth invention of the present application is directed to the refrigerating apparatus according to the fourth invention, wherein the second heat absorbing means functions in a lower temperature range than the first heat absorbing means.

A sixth invention of the present application is directed to a refrigerator comprising the refrigerating apparatus according to any one of the first to fifth inventions.

A seventh invention of the present application is directed to the refrigerator according to the sixth invention, which comprises a refrigerating room and a freezing room to be operated at a lower temperature than the refrigerating room, the refrigerating room being cooled by the first heat absorbing means, and the freezing room being cooled by the second heat absorbing means.

An eighth invention of the present application is directed to the refrigerator according to the seventh invention, wherein the refrigerant is allowed to flow in the first and second heat absorbing means, when a temperature of the refrigerating room and/or the freezing room is higher than a predetermined temperature.

A ninth invention of the present application is directed to the refrigerating apparatus according to any one of the first to fifth inventions and the refrigerator according to any one of the sixth to eighth inventions, wherein carbon dioxide is used as the refrigerant.

DETAILED DESCRIPTION OF THE PREFERRED EMBODIMENT

Hereinafter, preferred embodiments of refrigerating apparatus of the present invention and refrigerators including the refrigerating apparatus will be described in detail with reference to drawings.

Embodiment 1

Figure 1:
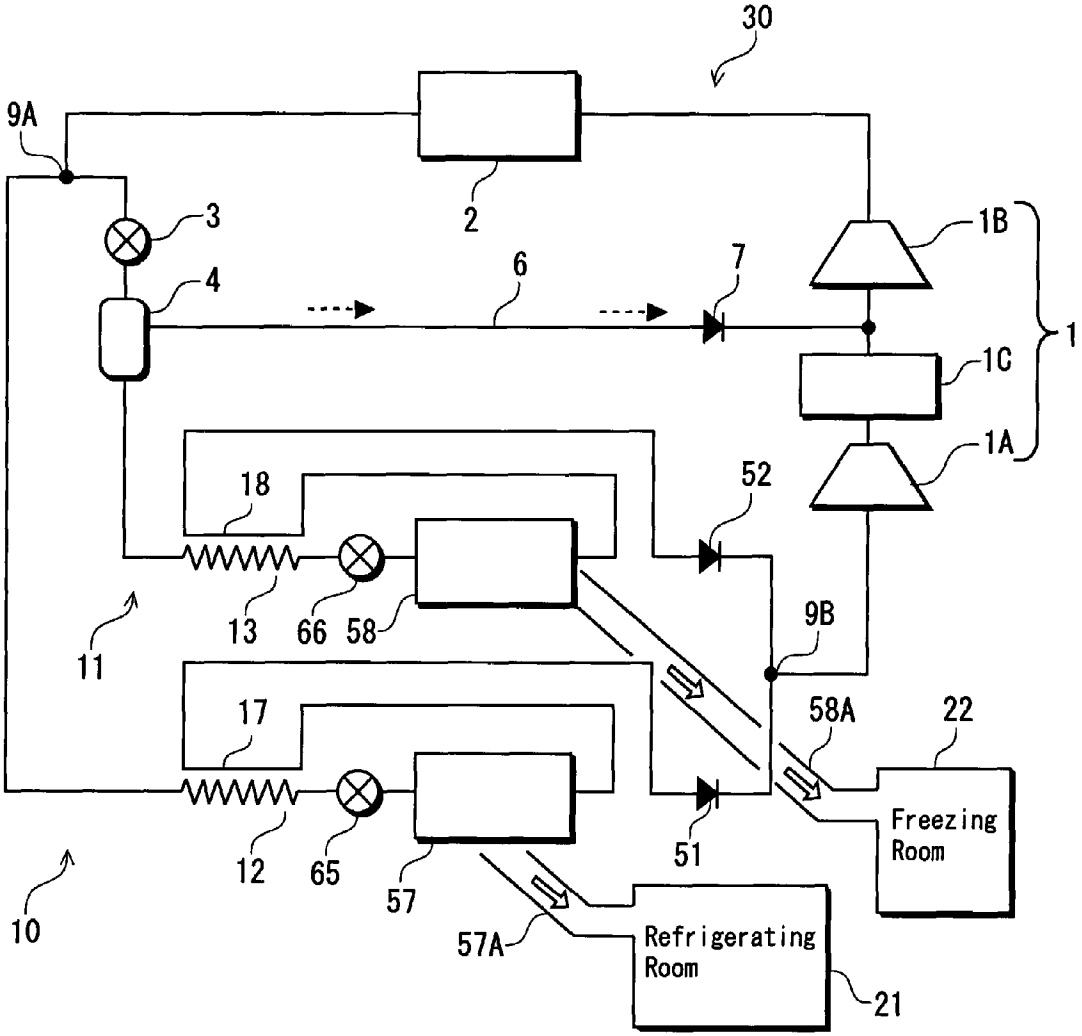
FIG. 1 is a refrigerant circuit diagram of a refrigerating apparatus according to an embodiment of the present invention.

An embodiment of the present invention will be described in detail with reference to drawings. FIG. 1 shows a refrigerant circuit diagram of a refrigerating apparatus 30 according to an embodiment of the present invention. The refrigerating apparatus 30 includes a compressor 1; a radiator 2 connected to a discharge side of the compressor 1; first heat absorbing means 10 connected to an outlet side of the radiator 2; and second heat absorbing means 11 provided in parallel with the first heat absorbing means 10. Outlet sides of the first and second heat absorbing means 10 and 11 are connected to a suction side of the compressor 1 to form a refrigerating cycle.

The first and second heat absorbing means 10 function in temperature ranges selectively different from each other. As described above, a refrigerant pipe from the radiator 2 branches at a branching point 9A. One branch is connected to the first heat absorbing means 10 and the other branch is connected to the second heat absorbing means 11, which are provided in parallel. The branches are again joined to each other at a joining point 9B before the suction side of the compressor 1.

The first heat absorbing means 10 includes a first capillary tube 12 in which a refrigerant from the branching point 9A flows; a first expansion valve 65 provided in series with the first capillary tube 12; a heat absorber 57 for refrigerating; a first heat exchanger 17 provided so as to be capable of heat exchange between a refrigerant which has come from the heat absorber 57 and a refrigerant in the vicinity of the first capillary tube 12; and a check valve 51. On the other hand, the second heat absorbing means 11, which is provided in parallel with the first heat absorbing means 10, includes a decompressor 3; a gas-liquid separator 4; a second capillary tube 13 in which the refrigerant from the gas-liquid separator 4 flows; a second expansion valve 66 provided in series with the second capillary tube 13; a heat absorber 58 for freezing; a second heat exchanger 18 provided so as to be capable of heat exchange between a refrigerant which has come from the heat absorber 58 and a refrigerant in the vicinity of the second capillary tube 13; a check valve 52; a refrigerant introducing pipe 6 connecting the gas-liquid separator 4 to an intermediate pressure portion of the compressor 1; and a check valve 7 provided in the refrigerant introducing pipe 6.

In this embodiment, the decompressor 3 is constructed such that, for example, the degree of aperture is variable. By changing the degree of aperture, it becomes possible that the refrigerant is lowered to a predetermined pressure before it reaches the gas-liquid separator 4; a gaseous refrigerant is generated; in this state, the refrigerant is introduced into the gas-liquid separator 4; and thereby, the separation efficiency of the gas-liquid separator 4 can be changed. In addition, the first and second expansion valves 65 and 66 are also constructed such that the degree of aperture is variable, like the decompressor 3.

The compressor 1 is a two-stage compressor that includes a first-stage compressing section 1A and a second-stage compressing section 1B. An intermediate cooler 1C is provided between the first-stage compressing section 1A and the second-stage compressing section 1B. The refrigerant introducing pipe 6 is connected so that the gaseous refrigerant separated by the gas-liquid separator 4 can be introduced into an intermediate pressure portion of the compressor 1, that is, a portion between the intermediate cooler 1C and the second-stage compressing section 1B. The gaseous refrigerant separated by the gas-liquid separator 4 is introduced into the intermediate pressure portion of the compressor 1 by the differential pressure in the refrigerant introducing pipe 6 as shown by broken arrows. The compressor 1 is not limited to such a two-stage compressor. For example, in the case of a single-stage compressor, the refrigerant introducing pipe 6 feeds back the refrigerant to an intermediate pressure portion of the single-stage compressor.

Each of the heat absorbing means 10 and 11 has the above construction. Thus, for example, when the decompressor 3 is fully closed and the first expansion valve 65 is opened, the refrigerant flows only on the first capillary tube 12 side, that is, in the first heat absorbing means 10. Contrastingly, when the first expansion valve 65 is fully closed and the decompressor 3 and the second expansion valve 66 are opened, the refrigerant flows only on the second capillary tube side, that is, in the second heat absorbing means 11.

The resistance value of the first capillary tube 12 is set so as to be higher than the resistance value of the second capillary tube 13. As a result, when the refrigerant flows in the first capillary tube 12 and the operation frequency of the compressor 1 is reduced, the flow rate in the heat absorber 57 decreases and the evaporation temperature in there rises, and thus a refrigerating operation is performed. This is because the evaporation temperature lowers if the operation frequency is fixed and only the resistance value of the capillary tube increases. The refrigerant which has come through the heat absorber 57 passes through the first heat exchanger 17 provided in the vicinity of the above-described first capillary tube 12. After heated by heat exchange in the first heat exchanger 17, the refrigerant passes through the check valve 51 and is fed back to the suction portion of the compressor 1.

On the other hand, when the refrigerant flows the second capillary tube 13 and the operation frequency of the compressor 1 is increased, the flow rate in the heat absorber 58 increases and the evaporation temperature in there lowers, and thus a freezing operation is performed. In this case, the refrigerant which has come through the heat absorber 58 passes through the second heat exchanger 18 provided in the vicinity of the above-described second capillary tube 13. After heated by heat exchange in the second heat exchanger 18, the refrigerant passes through the check valve 52 and is fed back to the suction portion of the compressor 1.

Further in this embodiment, cold air which has come through the heat absorber 57 is fed into a refrigerating room 21 through a duct 57A, and cold air which has come through the heat absorber 58 is fed into a freezing room 22 through a duct 58A.

As the refrigerant in the refrigerating apparatus 30 of this embodiment, a carbon dioxide refrigerant ($CO_2$) as a natural refrigerant is used in consideration of the gentleness to the global environment, combustibility, toxicity, and so on. As oil as lubricating oil of the compressor 2, for example, mineral oil, alkyl benzene oil, ether oil, ester oil, PAG (polyalkylen glycol), POE (polyol ester), or the like, is used.

In the above-described construction, operations of the refrigerating apparatus 30 of this embodiment will be described with reference to FIGS. 1 to 3.

Figure 2:
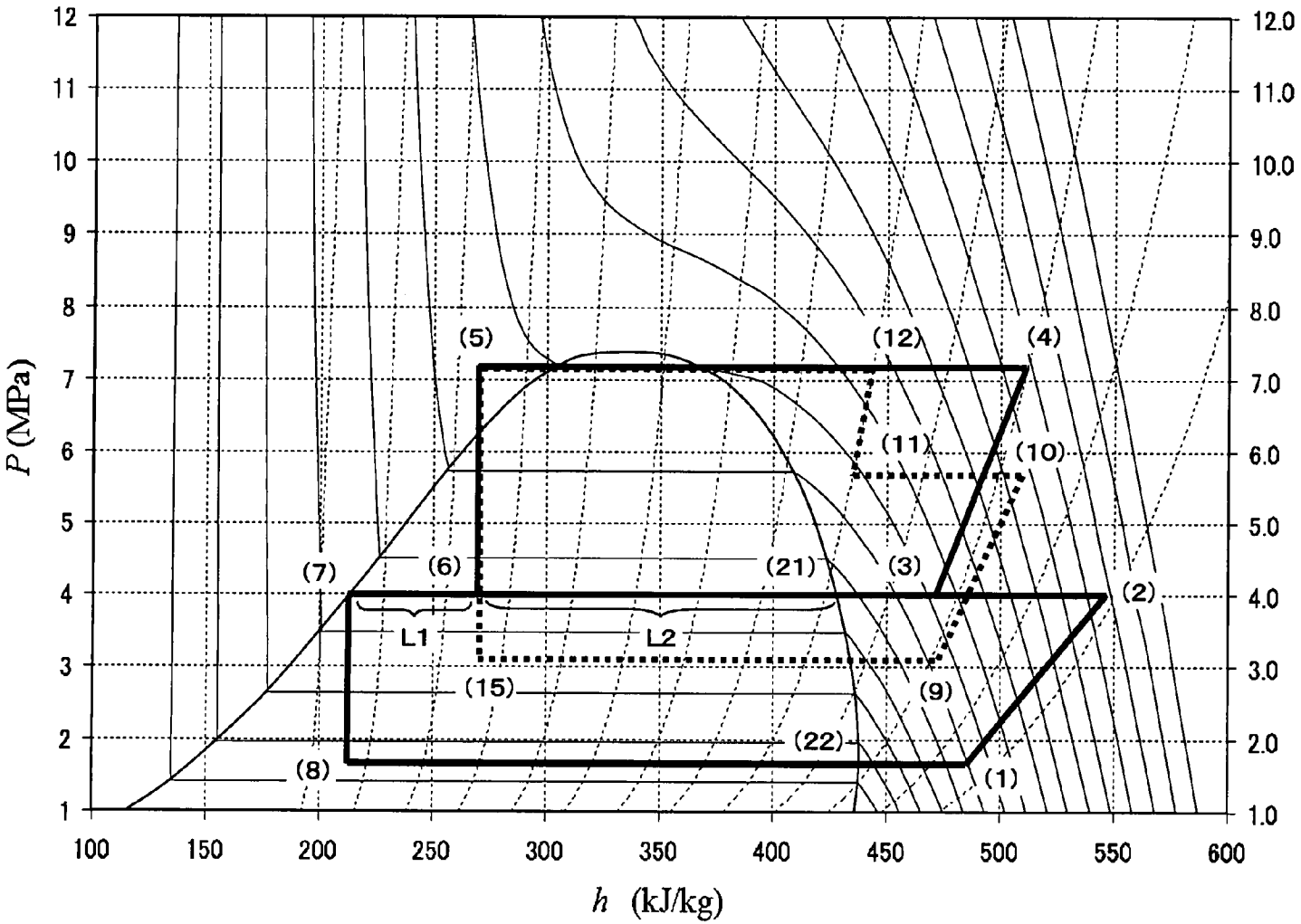
FIG. 2 is an enthalpy-pressure chart of a refrigerating cycle of the refrigerating apparatus according to the embodiment of the present invention.

FIG. 2 is an enthalpy-pressure (ph) chart of the refrigerating cycle of this embodiment. The carbon dioxide refrigerant is used in this embodiment. Thus, in accordance with conditions in the case that the atmospheric temperature is 30° C. or more, for example, in summer, or in the case of a heavy load, the interior of the high-pressure side circuit is operated at a super critical pressure in the operation of the refrigerating apparatus 30.

First, a freezing operation (e.g., about −26° C.) will be described using cycles shown by solid lines in FIGS. 2 and 3. This freezing operation is a case where a refrigerant flows on the above-described second capillary tube 13 side, that is, in the second heat absorbing means 11. In this embodiment, when the compressor 1 is put in operation, the refrigerant discharged out of the compressor 1 releases heats in the radiator 2 to be cooled. That is, first, the refrigerant flows in the order of (1) the suction of the first-stage compressing section 1A; (2) the discharge of the first-stage compressing section 1A; (3) the outlet of the intermediate cooler 1C and the suction of the second-stage compressing section 1B; and (4) the discharge of the second-stage compressing section 1B. Afterward, the refrigerant reaches (5) the inlet of the decompressor 3 and (6) the outlet of the decompressor 3. In this state, the refrigerant is a two-phase mixture of gas/liquid.

The ratio between gas and liquid in there corresponds to the ratio between the length of a segment of L1 (gas) and the length of a segment of L2 (liquid). The refrigerant enters the gas-liquid separator 4 in the state of the two-phase mixture. A gaseous refrigerant separated there is introduced into the intermediate pressure portion of the compressor 1, that is, the portion between the intermediate cooler 1C and the second-stage compressing section 1B. Reference numeral (21) denotes the outlet of the gas-liquid separator 4. The refrigerant which has come through this outlet reaches the suction of the second-stage compressing section 1B of (3), wherein the refrigerant is compressed. On the other hand, a liquid refrigerant separated by the gas-liquid separator 4 reaches the second capillary tube 13. Reference numeral (7) denotes the outlet of the gas-liquid separator 4 and the inlet of the second capillary tube 13; (8) does the outlet of the second expansion valve 66; and (22) does the outlet of the heat absorber 58. The liquid refrigerant which has entered the heat absorber 58 evaporates and absorbs heats from the surroundings; then exchanges heats with the refrigerant in the vicinity of the second capillary tube 13 in the second heat exchanger 18; and then returns to the suction of the first-stage compressing section 1A of (1).

Figure 3:
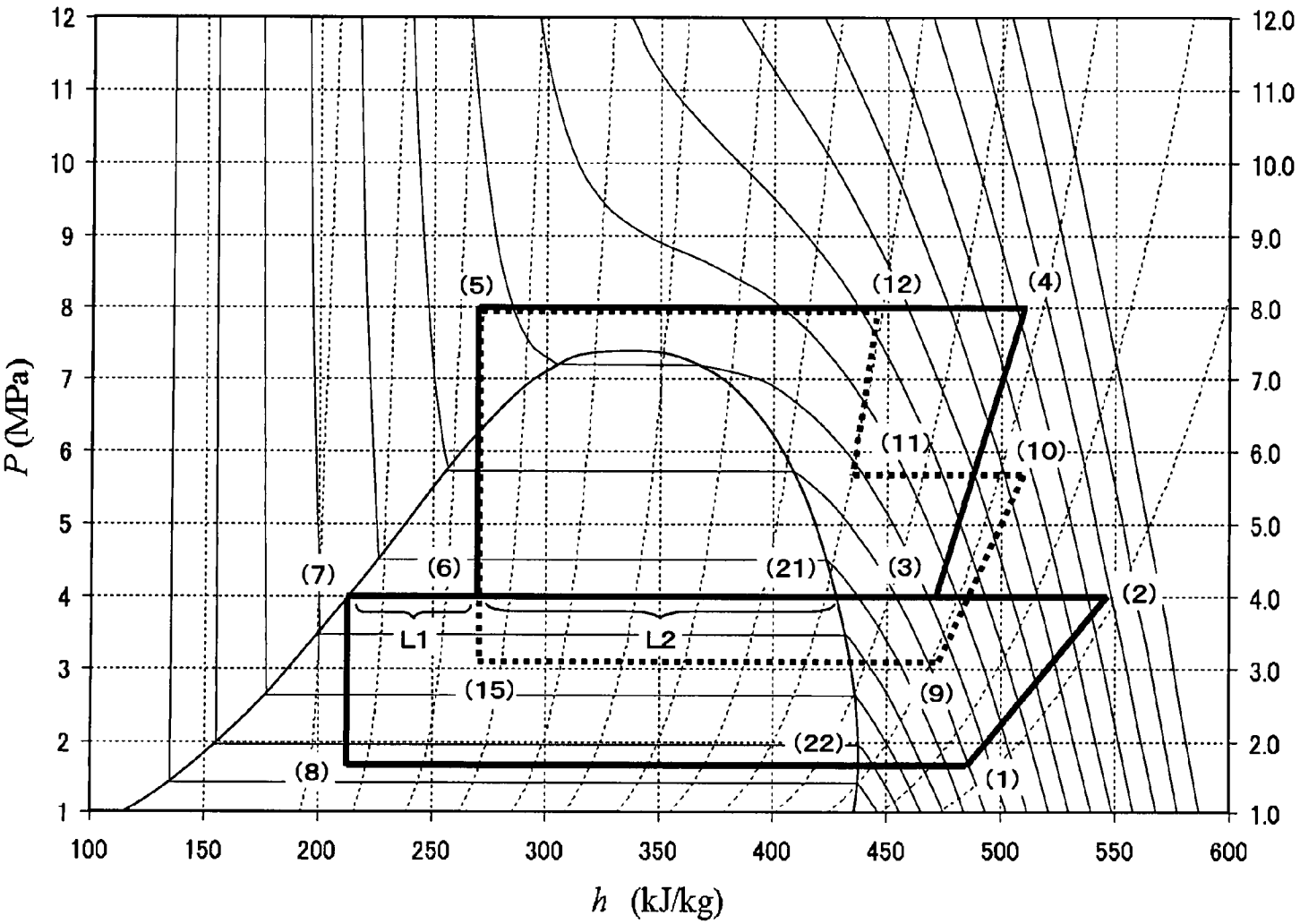
FIG. 3 is an enthalpy-pressure chart of a super critical refrigerating cycle of the refrigerating apparatus according to the embodiment of the present invention.

Contrastingly in a refrigerating operation (e.g., about −5° C.), cycles shown by broken lines in FIGS. 2 and 3 are formed. This refrigerating operation is a case where the refrigerant flows on the above-described first capillary tube 12 side, that is, in the first heat absorbing means 10. Also in this case, when the compressor 1 is put in operation, the refrigerant discharged out of the compressor 1 releases heats in the radiator 2 to be cooled. That is, the refrigerant flows in the order of (9) the suction of the first-stage compressing section 1A; (10) the discharge of the first-stage compressing section 1A; (11) the outlet of the intermediate cooler 1C and the suction of the second-stage compressing section 1B; and (12) the discharge of the second-stage compressing section 1B. Afterward, the refrigerant flows in the order of (5) the inlet of the first capillary tube 12 and (15) the outlet of the first expansion valve 65, and then reaches the heat absorber 57. The refrigerant which has entered the heat absorber 57 evaporates and absorbs heats from the surroundings; then exchanges heats with the refrigerant in the vicinity of the first capillary tube 12 in the first heat exchanger 17; and then returns to the suction of the first-stage compressing section 1A of (9). In either of the freezing and refrigerating operations, the refrigerant is circulated as described above and changes in its state, and thereby a refrigerating cycle is formed.

In the above-described freezing operation, even if the gaseous refrigerant separated by the gas-liquid separator 4 is circulated to the heat absorbing means 10 made up of the second capillary tube 13 and so on, the refrigerant cannot be used for cooling. Thus, returning the refrigerant to the suction of the first-stage compressing section 1A reduces the compression efficiency of the compressor 1.

In this embodiment, because the gaseous refrigerant separated by the gas-liquid separator 4 is introduced into the intermediate pressure portion of the compressor 1, that is, the portion between the intermediate cooler 1C and the second-stage compressing section 1B, the compression efficiency of the compressor 1 can be improved. Particularly in this embodiment, because a carbon dioxide refrigerant is sealed in the refrigerant circuit, the share of gas (the segment L1) in the ratio between the gas and liquid separated by the gas-liquid separator 4 is large in comparison with a chlorofluorocarbon-base refrigerant. By introducing the large share of gas into the intermediate pressure portion of the compressor 1, higher efficiency improvement can be intended.

In the case of the freezing operation, the quantity of the gaseous refrigerant separated by the gas-liquid separator 4 is large in comparison with the case of the refrigerating operation. In this embodiment, therefore, by using in the freezing operation the heat absorber 58 that functions in a temperature range lower than that of the heat absorber 57 for refrigerating, a highly efficient freezing operation can be performed.

In the refrigerating operation, because the construction is adopted in which the refrigerant flows in the first heat absorbing means 10, the function of the refrigerant introducing pipe 6 cannot be used that is for introducing the gaseous refrigerant separated by the gas-liquid separator 4, into the intermediate pressure portion of the compressor 1. In the refrigerating operation, however, the quantity of the gaseous refrigerant generated in the gas-liquid separator 4 is small in comparison with that in the freezing operation. Thus, even if the operations of the decompressor 3, the refrigerant introducing pipe 6, and so on, are stopped, the deterioration of the operation efficiency can be suppressed.

Further in this embodiment, the heat absorbers 57 and 58 are selectively used on the basis of the use temperature range, as described above. Thus, in the freezing and refrigerating operations different in temperature range, the heat absorber suitable for the temperature can be used. Therefore, the operation efficiency of either operation can be expected to be improved.

In the refrigerating operation of the refrigerating apparatus 30 of this embodiment, a refrigerant in the vicinity of the first capillary tube 12 is subjected to heat exchange by the first heat exchanger 17 with a refrigerant which has come from the heat absorber 57; then introduced into the first expansion valve 65 to be subjected to an aperture operation; and then introduced into the heat absorber 57. On the other hand, in the freezing operation, a refrigerant in the vicinity of the second capillary tube 13 is subjected to heat exchange by the second heat exchanger 18 with a refrigerant which has come from the heat absorber 58; then introduced into the second expansion valve 66 to be subjected to an aperture operation; and then introduced into the heat absorber 58. Thus, the refrigerating cycle efficiency can be expected to be furthermore improved, and further a reduction of the power consumption of the compressor 1 can be realized.

Next, an example in which the refrigerating apparatus 30 of this embodiment is applied to a refrigerator will be described with reference to FIG. 4.

Figure 4:
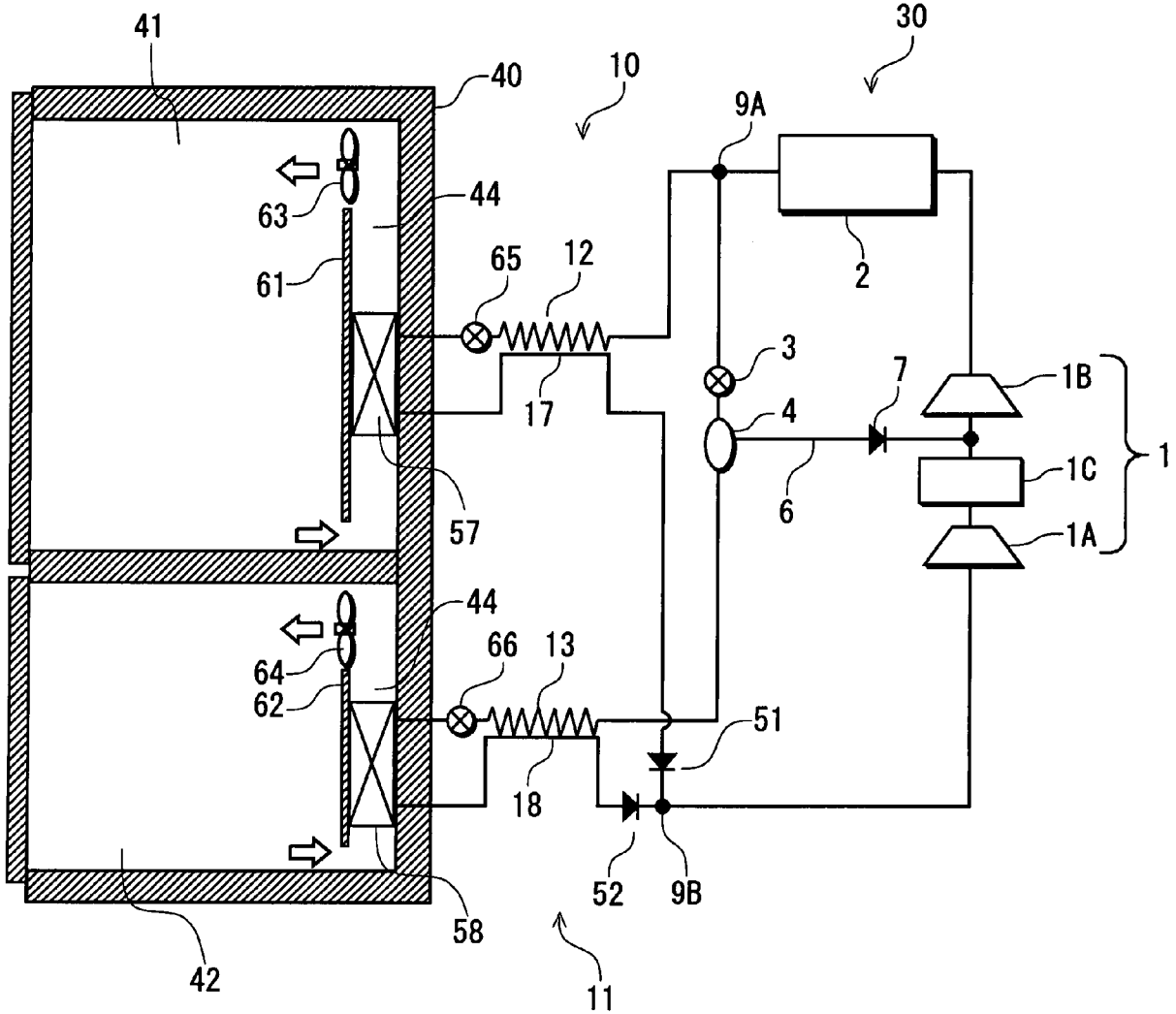
FIG. 4 is a schematic view showing a construction of an example in which the refrigerating apparatus according to the embodiment of the present invention is applied to a refrigerator.

FIG. 4 shows a schematic view of the construction of a refrigerator including the refrigerating apparatus 30 of this embodiment. The refrigerator 40 has a refrigerating room 41 in an upper portion and a freezing room 42 in a lower portion. Partition walls in chamber 61 and 62 are provided in back portions of the respective rooms 41 and 42. The above-described heat absorbers 57 and 58 and fans 63 and 64 are disposed within air passages 44 separated by the respective partition walls in chamber 61 and 62. In this construction, in accordance with thermo on and off of the refrigerating and freezing operations, the first and second heat absorbing means 10 and 11 are switched over as described above. A refrigerant flows in one of the heat absorbers 57 and 58, and the corresponding fan 63 or 64 is driven. When the refrigerant flows in the heat absorber 57, cold air is supplied to the refrigerating room 41. When the refrigerant flows in the heat absorber 58, cold air is supplied to the freezing room 42.

As described above, in the refrigerating apparatus 30 of this embodiment, in the freezing operation, the first expansion valve 65 is fully closed and the decompressor 3 and the second expansion valve 66 are opened to allow the refrigerant to flow in the second heat absorbing means 11. On the other hand, in the refrigerating operation, the decompressor 3 is fully closed and the first expansion valve 65 is opened to allow the refrigerant to flow in the first heat absorbing means 10. However, the present invention is not limited to that. For example, in the refrigerator 40, in the case that the refrigerating and freezing rooms 41 and 42 are at the normal temperature and rapidly cooling is required, in so-called pulldown, in the case that the compressor 1 is started to operate from an operation stop state and in heavy load, further, in the case that temperatures of the refrigerating and freezing rooms 41 and 42 are higher than predetermined temperatures, or a temperature of the refrigerating or freezing room 41 or 42 is higher than a predetermined temperature, or the like, all of the first expansion valve 65, the decompressor 3, and the second expansion valve 66 may be opened to necessary degrees of opening to allow the refrigerant to flow in both of the first and second heat absorbing means 10 and 11. Thereby, the interiors of the respective rooms 41 and 42 can be rapidly cooled.

Embodiment 2

Figure 5:
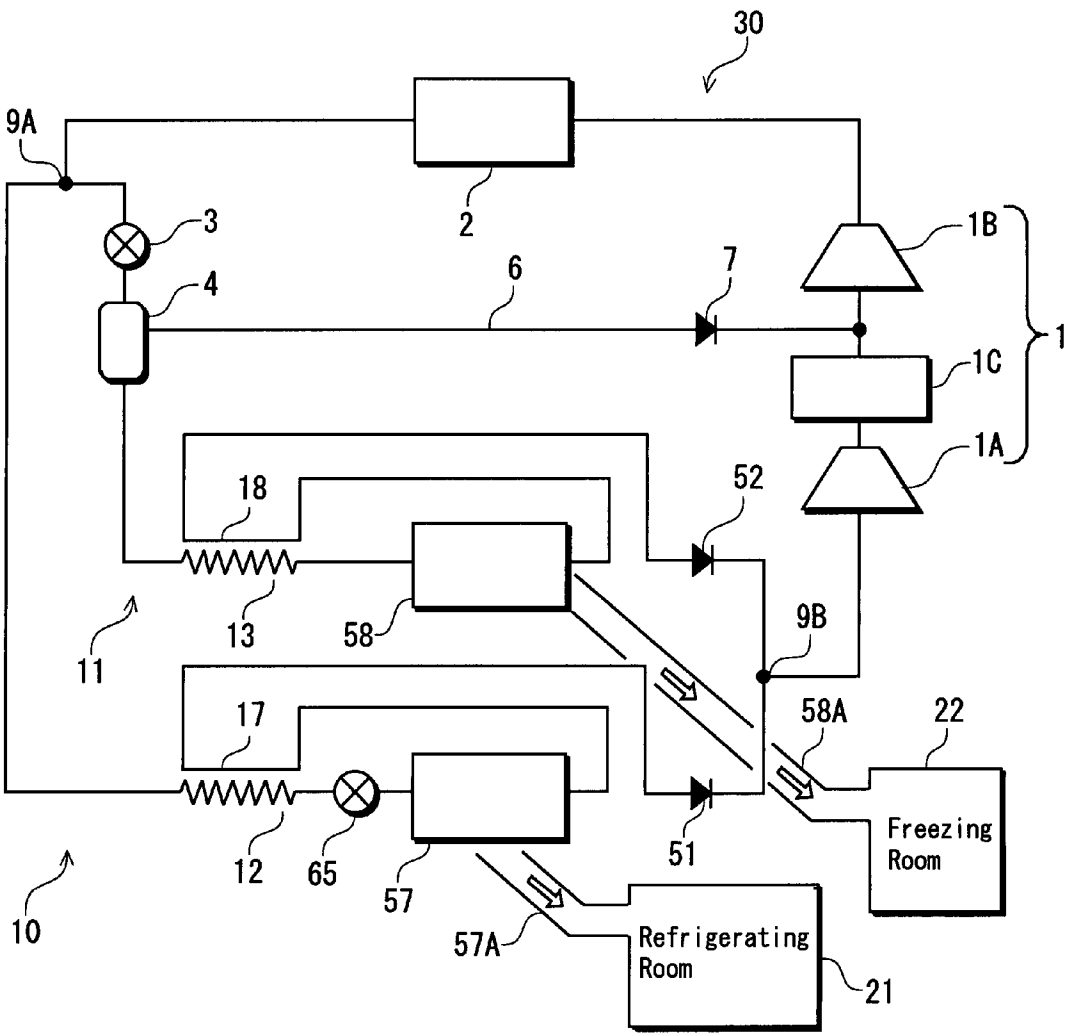
FIG. 5 is a refrigerant circuit diagram of a refrigerating apparatus according to another embodiment of the present invention.
Figure 6:
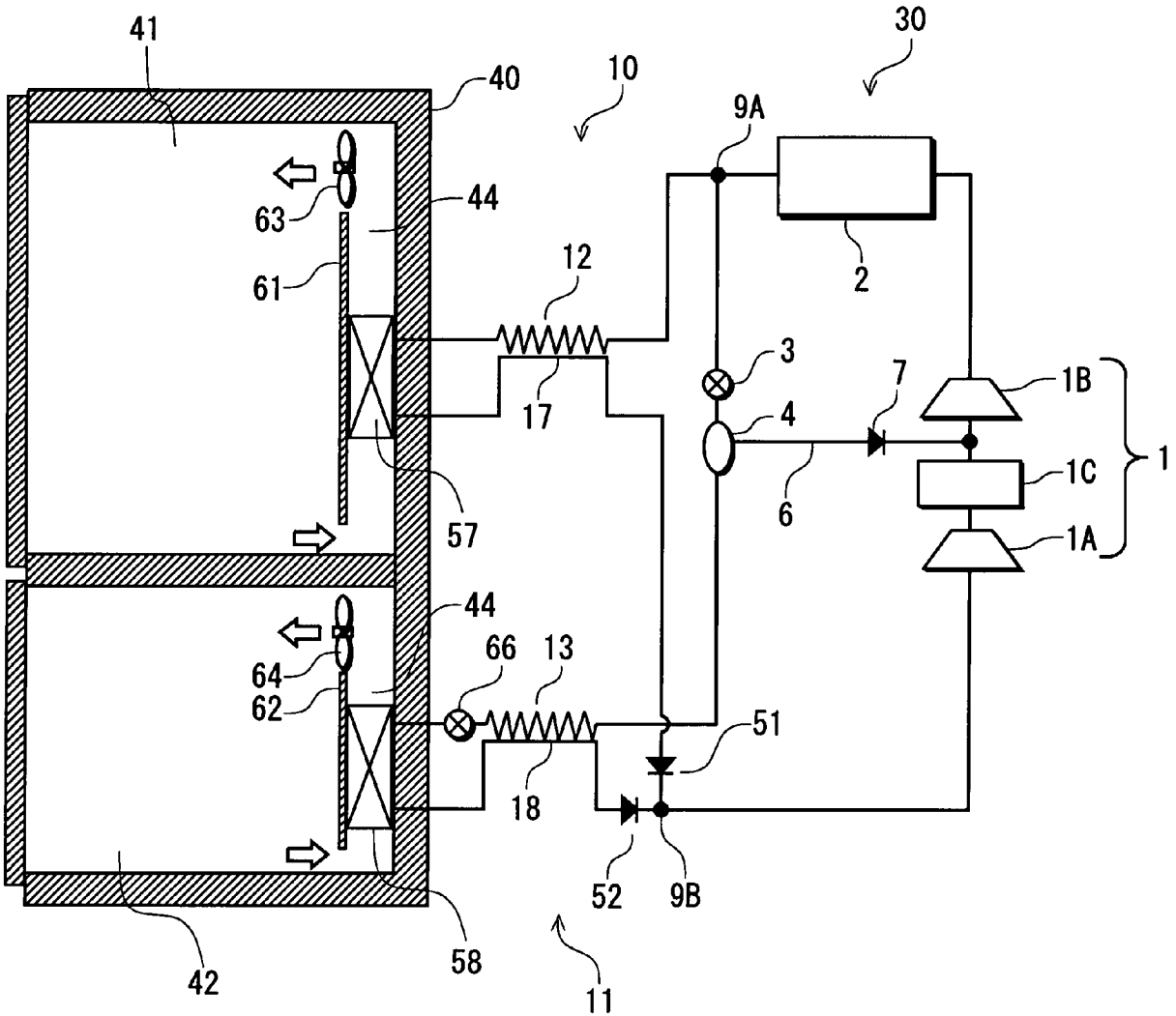
FIG. 6 is a schematic view showing a construction of an example in which the refrigerating apparatus according to the other embodiment of the present invention is applied to a refrigerator.

Next, another embodiment of the present invention will be described with reference to FIGS. 5 and 6. FIG. 5 shows a refrigerant circuit diagram of a refrigerating apparatus 30 of this case. FIG. 6 shows a schematic view of the construction of a refrigerator including the refrigerating apparatus 30 of this case. In comparison with Embodiment 1 as described above, this embodiment differs in the point that the second heat absorbing means does not have the second expansion valve 66. That is, in the freezing operation of this embodiment, a refrigerant which has come from the second capillary tube 13 is introduced directly into the heat absorber 58. Thus, in the refrigerating apparatus 30 and the refrigerator 40 of this embodiment, by the construction in which the second expansion valve 66 is omitted, an effect of cost reduction can be expected in comparison with Embodiment 1 as described above.

Although the present invention has been described in the embodiments, the present invention is not limited to the embodiments. Various changes in implementation can be made therein. For example, in either of the above-described embodiments, a carbon dioxide refrigerant is sealed in the refrigerant circuit. However, the present invention is not limited to that. It is needless to say that the present invention is applicable also to a refrigerant circuit in which a chlorofluorocarbon-base refrigerant other than the carbon dioxide refrigerant is sealed.

What is claimed is:

1. A refrigerating apparatus comprising a compressor, a radiator connected to a discharge side of the compressor, first heat absorbing means connected to an outlet side of the radiator, and second heat absorbing means provided in parallel with the first heat absorbing means, outlet sides of the first and second heat absorbing means being connected to a suction side of the compressor, the first heat absorbing means comprising first decompressing means, a first heat absorber, and a first heat exchanger configured to carry out heat exchange between a refrigerant which has come from the first heat absorber and a refrigerant flowing in the first decompressing means, and the second heat absorbing means comprising a second decompressing means, a second heat absorber, and a second heat exchanger configured to carry out heat exchange between a refrigerant which has come from the second heat absorber and a refrigerant flowing in the second decompressing means.

2. The refrigerating apparatus according to claim 1, wherein the compressor has an intermediate pressure portion, the second heat absorbing means further comprises a decompressor and a gas-liquid separator between the radiator and the second decompressing means, the refrigerating apparatus being provided with a refrigerant introducing pipe to introduce a gaseous refrigerant separated by the gas-liquid separator, into the intermediate pressure portion.

3. The refrigerating apparatus according to claim 1, wherein the first decompressing means comprises a capillary tube and an expansion valve, and the second decompressing means comprises a capillary tube.

4. The refrigerating apparatus according to claim 1, wherein the first and second heat absorbing means function in selectively different temperature ranges.

5. The refrigerating apparatus according to claim 4, wherein the second heat absorbing means functions in a lower temperature range than the first heat absorbing means.

6. A refrigerator comprising the refrigerating apparatus according to any one of claims 1 to 5.

7. The refrigerator according to claim 6, which comprises a refrigerating room and a freezing room to be operated at a lower temperature than the refrigerating room, the refrigerating room being cooled by the first heat absorbing means, and the freezing room being cooled by the second heat absorbing means.

8. The refrigerator according to claim 7, wherein the refrigerant is allowed to flow in the first and second heat absorbing means, when a temperature of the refrigerating room and/or the freezing room is higher than a predetermined temperature.

9. The refrigerating apparatus according to any one of claims 1 to 5 and the refrigerator according to any one of claims 7 to 8, wherein carbon dioxide is used as the refrigerant.

* * * * *